United States Patent [19]

Harris

[11] Patent Number: 4,871,337

[45] Date of Patent: Oct. 3, 1989

[54] BINDING WITH LONGITUDINAL AND ANGULAR ADJUSTMENT

[75] Inventor: Troy L. Harris, Oklahoma City, Okla.

[73] Assignee: Treon Corporation, Oklahoma City, Okla.

[21] Appl. No.: 78,415

[22] Filed: Jul. 27, 1987

[51] Int. Cl.[4] ..... B63B 35/80

[52] U.S. Cl. ..... 441/74; 441/74; 280/633; 280/14.2

[58] Field of Search ..... 441/65, 68, 70, 74, 441/75; 114/39.2, 204, 362; 244/122 R; 248/503.1; 280/12 H, 633

[56] References Cited

U.S. PATENT DOCUMENTS

| | | | |
|---|---|---|---|
| 3,049,734 | 8/1962 | Johnson et al. | 280/633 |
| 3,593,356 | 7/1971 | Schmalfeldt | 441/74 |
| 4,604,070 | 8/1986 | McKee et al. | 441/70 |
| 4,688,843 | 8/1987 | Hall | 248/503.1 |
| 4,758,192 | 7/1988 | Marks | 441/70 |

FOREIGN PATENT DOCUMENTS

| | | | |
|---|---|---|---|
| 0179424 | 4/1986 | European Pat. Off. | 441/74 |
| 3023419 | 1/1982 | Fed. Rep. of Germany | 441/70 |
| 2575660 | 7/1986 | France | 280/12 H |
| 2593135 | 7/1987 | France | 441/70 |

OTHER PUBLICATIONS

Kidder Skis, '86 Catalog, Auburn, Wash., 9-26-85, pp. 3, 5.

*Primary Examiner*—Joseph F. Peters, Jr.
*Assistant Examiner*—Edwin L. Swinehart
*Attorney, Agent, or Firm*—Dunlap, Codding, Peterson & Lee

[57] ABSTRACT

A riding apparatus, such as a water ski board or snow ski board, in which the rider's feet are positionable within bindings formed on first and second riding plates. Each riding plate is positionable above a channel section formed within a rider support surface of the riding apparatus. Fasteners supported by each riding plate are releasably engageable with retaining elements installed within the channel section. After loosening the fasteners from the retaining elements, each riding plate may be repositioned angularly or longitudinally with respect to its channel section, thereby permitting the apparatus to be used with a variety of stances and leg spacings.

23 Claims, 2 Drawing Sheets

BINDING WITH LONGITUDINAL AND ANGULAR ADJUSTMENT

FIELD OF THE INVENTION

The present invention generally relates to a riding apparatus, such as a water ski board or sailboard, with bindings which may be longitudinally and angularly positioned.

SUMMARY OF THE INVENTION

The present invention comprises a riding apparatus having a rider support surface formed therein. Supported on the rider support surface are at least one riding plate and means for longitudinally positioning the riding plate on the rider support surface. The invention further comprises means for attaching at least one of the rider's limbs to the riding plate.

The present invention further comprises a riding apparatus having a rider support surface formed thereon. Supported on the rider support surface are at least one riding plate and means for angularly positioning the riding plate on the rider support surface. The invention further comprises means for attaching at least one of the rider's limbs to the riding plate.

DETAILED DESCRIPTION OF THE PREFERRED EMBODIMENTS

Figure 1:
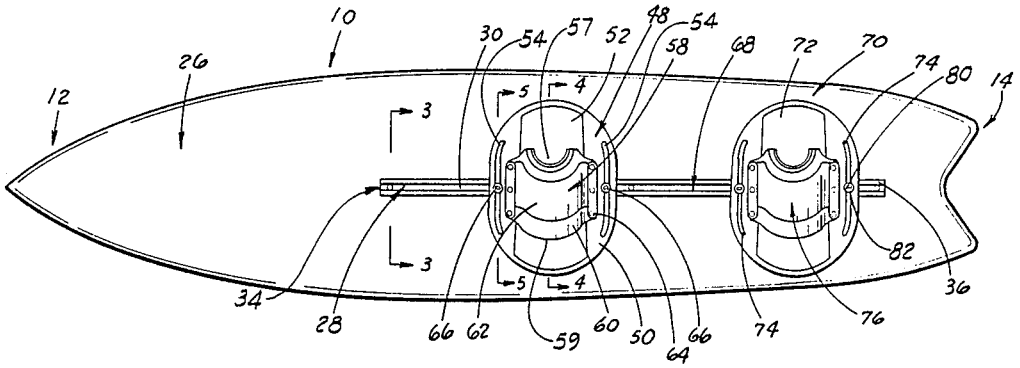
FIG. 1 is a plan view of the riding apparatus of the present invention.
Figure 2:
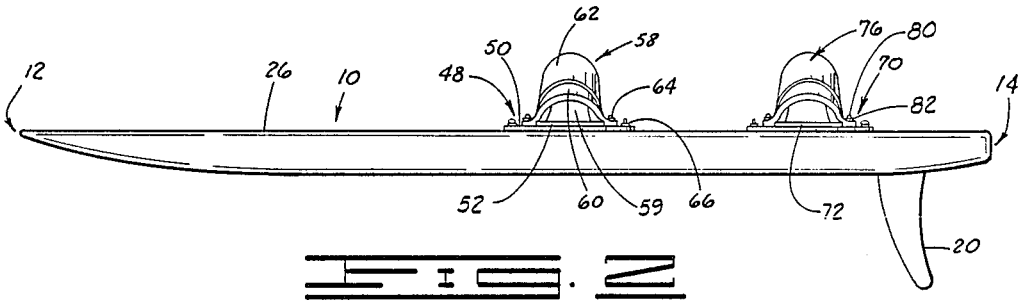
FIG. 2 is a side elevational view of the riding apparatus shown in FIG. 1.

With reference to FIGS. 1 and 2, the present invention comprises a riding apparatus 10, which preferably comprises a buoyant aquatic device. In a preferred embodiment, the riding apparatus 10 may comprise a water ski on which both of the rider's feet are positionable, generally known as a water ski board. Alternately, the riding apparatus 10 may comprise a sailboard or wind surfing board. In another embodiment, not shown in the Figures, the riding apparatus may comprise a snow ski, and more preferably a snow ski on which both of a skier's feet are positionable, generally known as a snow ski board. In general, the riding apparatus of the present invention may comprise any ridable device which requires one or more of the rider's limbs to be bound to the device while it is being used.

Figure 3:
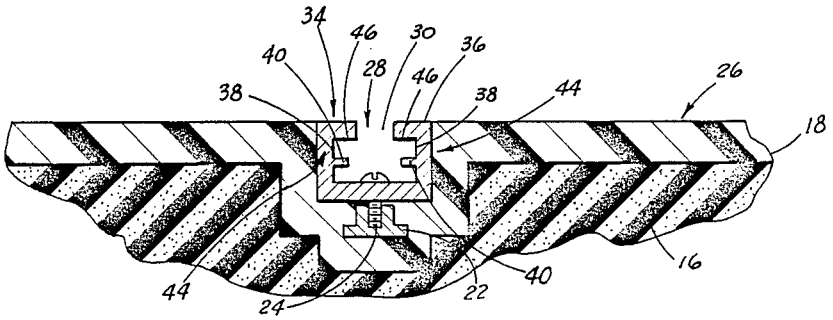
FIG. 3 is a cross-sectional view of the riding apparatus of the present invention, taken along line 3—3 shown in FIG. 1. The rider support surface and core have been partially cut away.
Figure 4:
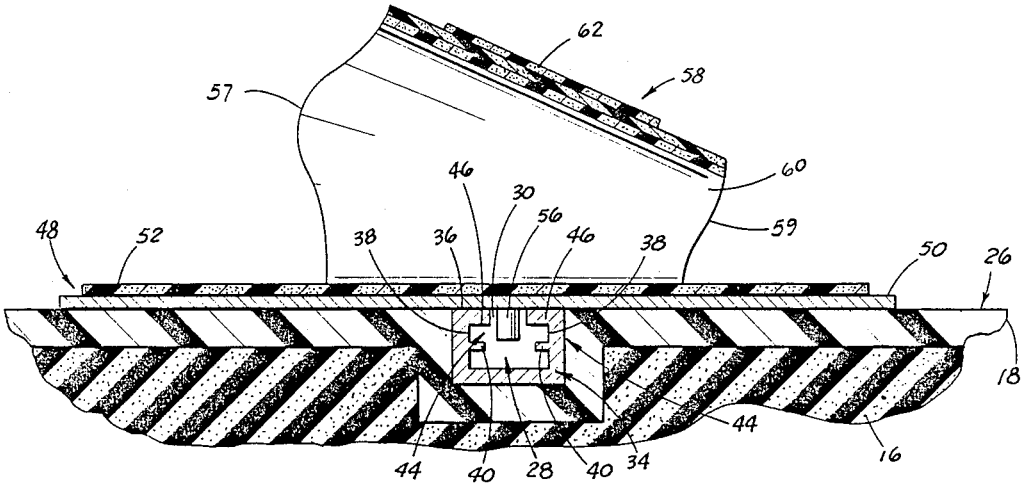
FIG. 4 is a cross-sectional view of the riding apparatus of the present invention, taken along line 4—4 shown in FIG. 1. The rider support surface and core have been partially cut away.
Figure 5:
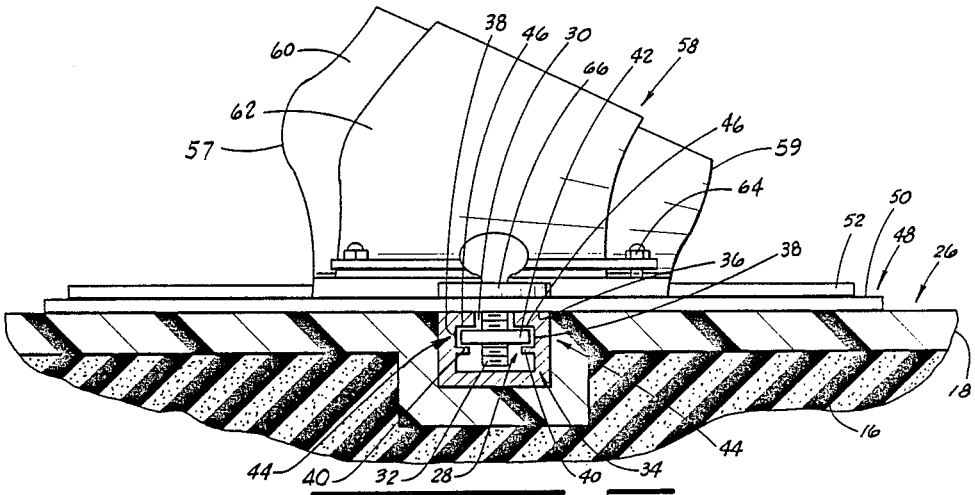
FIG. 5 is a cross-sectional view of the riding apparatus of the present invention, taken along line 5—5 shown in FIG. 1. The rider support surface and core have been partially cut away.

In the embodiment shown in the Figures, the riding apparatus 10 comprises a water ski board. In a preferred embodiment, such a water ski board will be an elongate structure, approximately 5 feet in length, having a tapered forward end 12 and a V-shaped rearward end 14, as shown in FIGS. 1 and 2. As shown in FIGS. 3–5, the riding apparatus 10 preferably is constructed from a central core 16, formed from a foam-like material such as polyurethane. Surrounding this core 16 is a shell 18, which preferably comprises a sturdy and durable material such as molded polyethylene or fiberglass. Preferably, the riding apparatus 10 is formed by rotomolding the polyethylene shell 18 and thereafter injecting polymeric foam in situ.

The materials forming the riding apparatus 10 preferably are sufficiently buoyant to support a rider in water, and sufficiently lightweight to be manually transportable by the rider to the area of use. The underside of the riding apparatus 10 may be equipped with a fin 20, as shown in FIG. 2. The fin 20 may be one of the type which is adjustably longitudinally positionable, such as the fin manufactured by Bahne & Co., P. O. Box 326, Encinitas, California 92024.

In order to permit attachment to the riding apparatus 10 of other components of the present invention, the shell 18 preferably is capable of retaining one or more fasteners, to be described hereafter. When the apparatus 10 includes a molded polyethylene shell 18 and a foam core 16, neither of which can hold conventionally drilled fasteners, one or more threaded "T" nuts 22 may be introduced within the mold used to cast the shell 18. When the shell 18 is molded, the polyethylene surrounds the "T" nuts, and the embedded "T" nuts 22 are thereafter capable of receiving and retaining fasteners, such as screws 24.

The riding apparatus 10 preferably is characterized by a flat or slightly concave rider support surface 26, which preferably is of sufficient size to permit a rider to stand on the rider support surface 26 with both feet. The rider support surface 26 preferably is provided with a water- and sun-resistant finish in order to prolong the useful life of the riding apparatus 10. The rider support surface 26 preferably is further provided with a non-slip textured finish in order to enhance a rider's grip thereon.

The rider support surface 26 preferably is further characterized by an elongate first channel section 28 formed therein. The first channel section 28 preferably comprises a linear recess which extends parallel to the longitudinal axis of the riding apparatus 10. The upper opening 30 of the first channel section 28 preferably is sufficiently sized to receive a fastener 32, to be described hereafter.

The first channel section 28 preferably is defined by an elongate bar element 34, as depicted in FIGS. 3 through 5. When the riding apparatus 10 comprises a water ski board of approximately 5 feet in length, the bar element 34 should be about 3 feet in length. The bar element 34 is fastened within an elongate opening formed in the rider support surface 26, preferably by a plurality of fasteners, such as screws 24, so that its upper surface 36 is flush with the rider support surface 26. The bar element 34 is a U-shaped structure formed from a lightweight, sturdy and rustproof material, such as aluminum. The interior portion of the "U" of the bar element 34 is coextensive with the first channel section 28 described previously.

Formed on the side walls 38 of the bar element 34 are a pair of opposed and spaced ledge elements 40, which extend parallel to the longitudinal axis of the bar element 34 and which preferably are longitudinally coextensive with the first channel section 28. The opposed ledge elements 40 are capable of supporting a retaining element 42, such as a nut, to be described in greater detail hereafter. The upper portion 44 of the bar element 34 is characterized by two opposed and spaced flange sections 46, which can cooperate with the ledge elements 40 to confine a retaining element 42 within the first channel section 28. Such a retaining element 42 can slide from end to end within the first channel section 28.

The riding apparatus 10 of the present invention further comprises a first riding plate 48, which preferably comprises a flat disc sufficiently sized to receive a limb, preferably a foot. The first riding plate 48 preferably is constructed from a durable and lightweight material, such as aluminum, and preferably is treated with a coating which is water-resistant, sun-resistant and rustproof.

Figure 7:
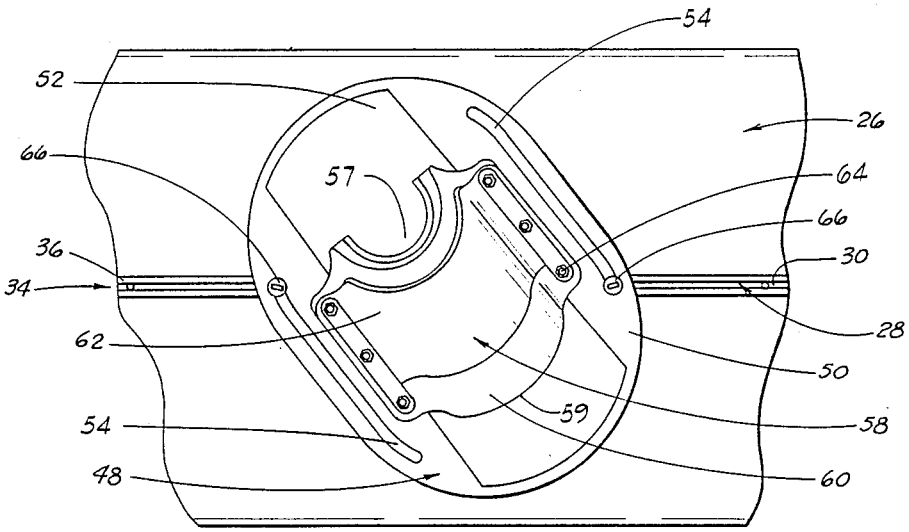
FIG. 7 is another detailed plan view of the riding plate shown in FIG. 6. The riding plate has been positioned so that the binding is skewed with respect to the longitudinal axis of the riding apparatus.

With reference to FIGS. 5 and 7, the upper surface 50 of the first riding plate 48 preferably is fitted with a cushioned pad 52 which is sized to receive and support the rider's foot. The pad 52 preferably is formed from a soft, pliable material, such as knobby rubber or vinyl, and is finished in a non-slip texture in order to enhance the rider's grip thereon. Formed adjacent the periphery of the first riding plate 48 are at least one, and preferably two, openings formed on opposite sides of the first riding plate 48. In the preferred embodiment of the apparatus of the present invention, each peripheral opening comprises an elongate slot 54.

The first riding plate 48 further comprises a guide element 56 which projects from the central portion of the lower surface of the first riding plate 48. Preferably, the guide element 56 projects axially from the first riding plate 48. The guide element 56 projects within the first channel section 28 and functions to guide angular and longitudinal positioning of the first riding plate 48, and prevents the first riding plate 48 from being disposed in an eccentric or unstable position. The guide element 56, which preferably is of cylindrical construction, should be formed from a sturdy and durable material, such as stainless steel.

The riding apparatus 10 of the present invention further comprises a first binding 58 which functions to attach at least one of a rider's limbs to the first riding plate 48. In the embodiment shown in FIGS. 1, 2, 5, 6 and 7, the first binding 58 is sized to receive and retain a single foot of the rider. The first binding 58, which is supported on the upper surface 50 of the first riding plate 48, preferably is formed from a flexible yet durable material, such as rubber or vinyl, which preferably is provided with a coating which is sun-resistant and water-resistant. Preferably, the first binding 58 is formed from layered rectangular strips which are formed into an inverted U-shaped structure and secured to the plate at opposite ends.

The first binding 58 preferably is open at both ends, having a rearward opening 57 and a forward opening 59, and is characterized by internal dimensions which taper from a maximum size adjacent the rearward opening 57 to a minimum size adjacent the forward opening 59. A rider's foot may be inserted through the rearward opening 57 and positioned on the pad 52 so that the rider's toes project outside the first binding 58 through the forward opening 59. When the rider's foot is so positioned, the first binding 58 engages the upper portion and sides of the foot, and holds against the first riding plate 48. In some instances the first binding 58 may be axially assymetrical, as required to fit a left foot or a right foot.

Figure 6:
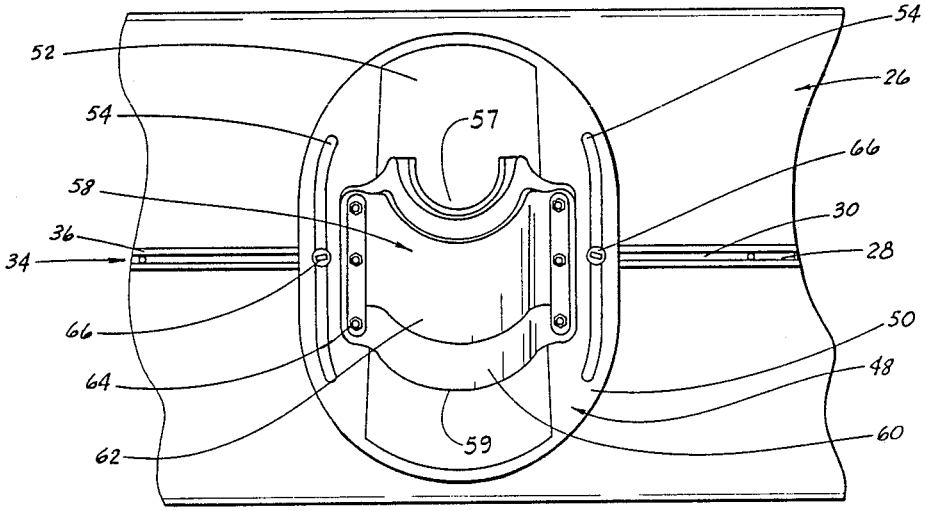
FIG. 6 is a detailed plan view showing one of the riding plates of the riding apparatus of the present invention. The riding plate is positioned so that the binding is perpendicular to the longitudinal axis of the riding apparatus.

In the embodiment shown in FIGS. 5 through 7, the first binding 58 is characterized by a two-layered structure: a cushioned lower binding layer 60, formed from a soft, cushioned, pliable material, which contacts the foot, and an upper binding layer 62, formed from a material that is stronger and less pliable than the lower layer. The upper binding layer 62 serves to restrain and retain the foot, while the lower binding layer 60 comforts the foot while it is in position on the first riding plate 48. The first binding 58 is attached to the upper surface 50 of the first riding plate 48, preferably with a plurality of binding fasteners 64, such as bolts. It should be understood that the upper binding layer 62 is not absolutely necessary, and that the lower binding layer 60 alone will function adequately as a first binding 58.

With reference to FIG. 5, at least one and preferably two fasteners 32, such as thumbscrews, each having a head 66, are supported by the first riding plate 48. In one embodiment, the fastener 32 may comprise a thumbscrew, and the head 66 may comprise a washer threaded onto or otherwise attached to the thumbscrew. Each fastener 32 extends through a corresponding slot 54 formed in the first riding plate 48, and projects within the first channel section 28. Each fastener 32 preferably is releasably engaged within the first channel section 28 by a retaining element 42, such as a nut. The fasteners 32 and retaining elements 42 are constructed from a sturdy, durable rustproof material, such as stainless steel. In the preferred embodiment shown in FIG. 5, the fastener 32 is provided with external threads which permit it to be releasably engaged with corresponding internal threads in the retaining element 42.

When each fastener 32 is tightly engaged with its corresponding retaining element 42, the first riding plate 48 is tightly sandwiched between the flange sections 46 of the bar element 34 and the head 66 of the fastener. In this sandwiched configuration, the first riding plate 48 is substantially immobile against both angular and longitudinal movement on the rider support surface 26. Such immobilization generally is desired when the first riding plate 48 of the present invention is bound to a rider's foot or limb, as during water sports or other recreational activities.

If it is desired to reposition the first riding plate 48 longitudinally on the rider support surface 26, the fasteners 32 are loosened sufficiently from engagement with the retaining elements 42 to permit the first riding plate 48 to move with respect to the flange sections 46. The first riding plate 48 then is moved longitudinally above the first channel section 28 to the desired position on the rider support surface 26. As the first riding plate 48 moves above the first channel section 28, the fasteners 32 move the same direction while continuing to project within the first channel section 28. During the longitudinal movement of the first riding plate 48, the guide element 56 functions to maintain the central portion of the first riding plate 48 in a position overlying the first channel section 28. As the first riding plate 48 and its supported fasteners 32 move longitudinally, the retaining elements 42 move a corresponding longitudinal distance in the first channel section 28, to a position underlying the new location of the first riding plate 48. Once the first riding plate 48 is repositioned, the fasteners 32 and retaining elements 42 are retightened, thereby immobilizing the first riding plate 48 in its new longitudinal position on the first rider support surface 26.

The angular movement of the first riding plate 48 is illustrated by FIGS. 6 and 7. If it is desired to angularly reposition the first riding plate 48 with respect to the rider support surface 26, as from the position shown in FIG. 6, the fasteners 32 are loosened sufficiently from engagement with the retaining elements 42 to permit angular movement of the first riding plate 48. The first riding plate 48 then is moved angularly, and preferably rotated, with respect to the rider support surface 26 to the desired position, such as that shown in FIG. 7. The range of angular movement of the first riding plate 48 is limited within the central angle defined by the elongate slot 54 formed in the periphery of the first riding plate 48.

During angular movement of the first riding plate 48, the guide element 56 remains within the first channel section 28 and preferably rotates about its longitudinal axis. The guide element 56 functions to maintain the central portion of the first riding plate 48 in a position overlying the first channel section 28, and peferably functions as a rotational axis for the first riding plate 48. As the first riding plate 48 and its supported fasteners 32 move angularly, the retaining elements 42 remain in a stationary position within the first channel section 28. Once the first riding plate 48 is repositioned, the fasteners 32 and retaining elements 42 are retightened, thereby immobilizing the first riding plate 48 in its new angular position on the rider support surface 26, as shown in FIG. 7.

From the foregoing, it will be appreciated that the fasteners 32, retaining elements 42, guide element 56, and the first channel section 28 cooperate to longitudinally position the first riding plate 48 on the rider support surface 26 in the apparatus 10 of the present invention. Likewise it will be appreciated that the same elements, in cooperation with the elongate slot 54 in the periphery of the first riding plate 48, function to angularly position the first riding plate 48.

While the guide element 56 is positioned within the first channel section 28 in the preferred embodiment just described, it should be understood that a first channel section is not strictly necessary for angular positioning of the first riding plate 48 in accordance with the present invention. In an alternate embodiment, the guide element 56 may be received within any other recess formed in the rider support surface 26, if such recess is sized to closely receive the guide element 56. However, if the recess is not channel-shaped, longitudinal movement of the first riding plate 48 may not be possible.

It should also be understood that while the openings formed in the first riding plate 48 comprise elongate slots 54 in the preferred embodiment just described, such slots 54 are not strictly necessary for longitudinal positioning of the first riding plate 48 in accordance with the present invention. In an alternate embodiment, any other opening which closely receives a fastener 32 may be formed in the first riding plate 48. However, if the opening is not an elongate slot, angular movement of the first riding plate 48 may not be possible.

The present invention further comprises a second channel section 68, of identical construction to the first channel section 28, formed in the rider support surface 26. The second channel section 68 preferably comprises a linear recess which extends parallel to the first channel section 28. More preferably, the second channel section 68 and the first channel section 28 are collinear, and most preferably, these channel sections are sections of a unitary channel, as shown in FIG. 1. In the embodiment shown in the Figures, the first and second channel sections are both defined by the bar element 34. Alternately, separate bar elements, each defining a single channel section, may be provided when the first and second channel sections are not contiguous.

The riding apparatus 10 of the present invention further comprises a second riding plate 70, as shown in FIG. 1, which is identical in construction to the first riding plate 48. The upper portion of the second riding plate 70 preferably is fitted with a cushioned pad 72 of the same type discussed with reference to the first riding plate 48. Projecting from the lower surface of the second riding plate 70 is a guide element (not shown) identical in construction to the guide element 56 shown in FIGS. 1, 6 and 7. Formed in the periphery of the second riding plate 70 are at least one, and preferably a plurality of openings, each of which preferably comprises an elongate slot 74. The slots 74 are positioned within the second riding plate 70 at the corresponding positions occupied by the slots 54 in the first riding plate 48.

The riding apparatus 10 of the present invention further comprises a second binding 76 which functions to attach one of the rider's limbs to the second riding plate 70. The second binding 76 is identical in construction and function to the first binding 58. In the embodiment shown in FIGS. 1 and 2, the second binding 76 is sized to receive and retain a single foot of the rider, and preferably the foot of the rider which is not received within the first binding 58 supported by the first riding plate 48. The second binding 76 preferably is secured to the second riding plate 70 in the same manner as the first binding 58 is attached to the first riding plate 48. If the first binding 58 is shaped to fit a limb on one side of the binding, such as a left foot, then the second binding 76 should be sized to fit the corresponding limb on the opposite side of the binding, such as a right foot.

With reference to FIGS. 1 and 2, at least one fastener 80, such as a thumbscrew, having a head 82, is supported by the second riding plate 70 in the same manner as previously discussed with reference to the first riding plate 48. Each fastener 80 is releasably engaged with the second channel section 68 by a retaining element (not shown), such as a nut. Each fastener 80 and each retaining element are constructed in the manner previously discussed with respect to the fasteners 32 and retaining elements 42 associated with the first riding plate 48. The second riding plate 70 is positionable longitudinally and angularly within the second channel section 68 and with respect to the rider support surface 26 in the same manner as discussed with reference to the first riding plate 48.

In preparation for use of the riding apparatus 10, the longitudinal and angular positions of the first riding plate 48 and the second riding plate 70 are determined and fixed as described above. The rider then inserts one foot (or other limb) into the first binding 58 and the other foot (or other limb) into the second binding 76. The riding apparatus 10 then is used by the rider in its normal mode of operation, whether as a water ski board, surfboard, or snow ski board. If the rider desires to reposition the first and second bindings 58 and 76, as required to accommodate a different rider or a different stance of the same rider, the rider first dismounts from the apparatus 10, and then repositions the first and second bindings 58 and 76, as described previously. The rider (who may be a different rider from the initial rider) then inserts his or her feet (or other limbs) into the first and second bindings 58 and 76, and resumes use of the riding apparatus 10.

As discussed previously, in some embodiments of the riding apparatus 10, the first binding 58 is assymetrical, so as to conform to a limb on one side of the rider's body, such as a right foot, while the second binding 76 is a mirror image of the first binding 58. In such an embodiment, only one of a rider's two limbs, such as the right foot, can be positioned in the forward binding for any given configuration of the apparatus 10. In the event that the rider desires to ride the apparatus 10 with a different limb forward than that normally placed in the forward binding, the fasteners may be removed from each binding, the positions of the first and second bindings reversed, and the fasteners engaged with corresponding retaining elements in the channel sections. After this operation, the forward binding fits the opposite limb from that which was forward in the original configuration of the apparatus 10.

In some instances, a rider of the apparatus 10 may desire to face a different direction while riding the apparatus 10, such as by facing to the right side of the apparatus 10, rather than the left side. Because of the limited range of rotation of the riding plate permitted by each slot, it may not be possible to accomplish this repositioning of the binding, as discussed above. In this event, one or both of the bindings may be repositioned by associating each fastener with a new and different slot that had been originally positioned in an area of the riding plate remote from that fastener. This repositioning is carried out by disengaging each fastener from its corresponding retaining element, rotating the riding plate until a new and different slot is moved into the region formerly occupied by each fastener, and thereafter reengaging the fasteners and retaining elements. This rotation of the riding plate will result in a reorientation of the binding supported thereon.

From the foregoing, it will be appreciated that the riding apparatus 10 of the present invention offers considerable flexibility in the placement of the bindings, thereby permitting a single apparatus 10 to be used by a variety of riders having different limb spans, and further accommodating a wide range of riding stances. The releasable nature of each riding plate with respect to the riding surface permits replacement of the riding plates when they become lost or damaged, or when a different size or style of riding plate is required. This feature permits the apparatus 10 to be used by a wide range of riders, while extending the useful life of the apparatus.

Changes may be made in the construction, operation and arrangement of the various parts and elements described herein without departing from the spirit and scope of the invention in the following claims.

What is claimed is:

1. A riding apparatus comprising:

a rider support surface;

a first riding plate supported by the rider support surface, the first riding plate sized to receive a rider's limb;

means for longitudinally positioning the first riding plate on the rider support surface characterized by an elongate first channel section formed in the rider support surface, the first channel section having a base, comprising:

at least one fastener supported by the first riding plate and projecting within the first channel section; and means for releasably engaging the fastener within the first channel section;

means for attaching at least one of a rider's limbs to the first riding plate;

means for selectively maintaining the first riding plate in a fixed position on the rider support surface while a rider's limb is attached to the first riding plate;

a second riding plate supported by the rider support surface, the second riding plate sized to receive a rider's limb;

means for longitudinally positioning the second riding plate on the rider support surface;

means for attaching at least one of a rider's limbs to the second riding plate; and means for selectively maintaining the second riding plate in a fixed position on the rider support surface while a rider's limb is attached to a second riding plate.

2. The apparatus of claim 1 in which the means for longitudinally positioning the first riding plate on the rider support surface further comprises:

a guide element supported by the first riding plate and projecting within the first channel section.

3. The apparatus of claim 1 in which the first riding plate is characterized by at least one opening formed in the periphery thereof, and in which the fastener extends through the peripheral opening.

4. The apparatus of claim 3 in which the means for longitudinally positioning the first riding plate further comprises:

a guide element supported by the first riding plate at a central portion thereof and projecting within the first channel section.

5. The apparatus of claim 1 in which the means for releasably engaging the fastener within the first channel section comprises:

at least one retaining element, confined within the first channel section, each retaining element engagable with a fastener and longitudinally positionable along the first channel section.

6. The apparatus of claim 5 in which the retaining element is disposed within the first channel section at a position spaced above the base thereof.

7. The apparatus of claim 1 in which the means for longitudinally positioning the second riding plate is characterized by an elongate second channel section formed in the rider support surface.

8. The apparatus of claim 7 in which the first channel section and the second channel section comprise sections of a unitary channel.

9. The apparatus of claim 8 in which the first channel section and the second channel section are collinear.

10. The apparatus of claim 1 further comprising:

means for angularly positioning the first riding plate with respect to the rider support surface.

11. The apparatus of claim 10 further comprising:

means for angularly positioning the second riding plate with respect to the rider support surface.

12. The apparatus of claim 1 further comprising:

means for angularly positioning the first riding plate with respect to the rider support surface, including at least one elongate peripheral slot formed in the first riding plate, through which the fastener extends.

13. The apparatus of claim 1 in which the rider support surface is incorporated within a buoyant aquatic device.

14. A riding apparatus comprising:

a rider support surface;

a first riding plate supported by the rider support surface;

means for angularly positioning the first riding plate with respect to the rider support surface comprising:

at least one elongate slot formed in the periphery of the first riding plate;

at least one fastener recess formed in the rider support surface;

at least one fastener supported by the first riding plate, extending through the peripheral slot formed therein and projecting within a corresponding fastener recess; and means for releaseably engaging the fastener within its corresponding fastener recess; and means for attaching at least one of a rider's limbs to the riding plate.

15. The apparatus of claim 14 in which the means for angularly positioning the first riding plate with respect to the rider support surface is characterized by a guide recess formed within the rider support surface, and further comprises:

a guide element supported by the first riding plate at a central portion thereof and projecting within the guide recess.

16. The apparatus of claim 15 further comprising:

means for longitudinally positioning the first riding plate with respect to the rider support surface including a first channel section formed in the rider support surface and subsuming each fastener recess and guide recess.

17. The apparatus of claim 14 further comprising:

means for longitudinally positioning the first riding plate with respect to the rider support surface.

18. The apparatus of claim 17 in which the means for longitudinally positioning the first riding plate with respect to the rider support surface is characterized by a first channel section formed in the rider support surface, the first channel section having a base, each fastener recess comprising a portion of the first channel section.

19. The apparatus of claim 18 in which the means for releasably engaging at least one fastener and the rider support surface within the fastener recess section comprises:

at least one retaining element confined within the first channel section, each retaining element engagable with a fastener and longitudinally positionable along the channel.

20. The apparatus of claim 19 in which each retaining element is disposed within the first channel section at a position spaced above the base thereof.

21. The apparatus of claim 14 further comprising:

a second riding plate supported by the riding surface; and means for attaching at least one of a rider's limbs to the second riding plate.

22. The apparatus of claim 14 in which the rider support surface is incorporated in a buoyant aquatic device.

23. An accessory for a riding apparatus comprising:

a riding plate positionable above the rider support surface of a riding apparatus;

means for attaching the riding plate to a rider support surface;

means for angularly positioning the riding plate with respect to a rider support surface comprising:

at least one elongate slot formed in the periphery of the first riding plate;

at least one fastener supportable by the first riding plate and extendable through a peripheral slot formed therein and projectable within a corresponding fastener recess formed in the rider support surface;

means for releasably engaging the fastener within its corresponding fastener recess; and means for attaching at least one of a rider's limbs to the riding plate.

* * * * *